US009165508B2

(12) United States Patent
Yamashita et al.

(10) Patent No.: US 9,165,508 B2
(45) Date of Patent: Oct. 20, 2015

(54) DISPLAY APPARATUS USING REFERENCE VOLTAGE LINE FOR PARASITIC CAPACITANCE, ELECTRONIC APPARATUS USING THE DISPLAY APPARATUS AND DRIVING METHOD OF THE DISPLAY APPARATUS

(71) Applicant: CANON KABUSHIKI KAISHA, Tokyo (JP)

(72) Inventors: Takanori Yamashita, Chiba (JP); Masami Iseki, Mobara (JP); Tatsuhito Goden, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 192 days.

(21) Appl. No.: 13/767,395

(22) Filed: Feb. 14, 2013

(65) Prior Publication Data

US 2013/0234918 A1 Sep. 12, 2013

(30) Foreign Application Priority Data

Mar. 9, 2012 (JP) ..... 2012-053168

(51) Int. Cl.
*G09G 3/32* (2006.01)
*G09G 3/34* (2006.01)

(52) U.S. Cl.
CPC ..... *G09G 3/34* (2013.01); *G09G 3/3225* (2013.01); *G09G 3/3258* (2013.01); *G09G 2310/0248* (2013.01); *G09G 2320/045* (2013.01)

(58) Field of Classification Search
CPC ..... G09G 3/30; G09G 3/32; G09G 3/3208; G09G 3/3225; G09G 3/3233; G09G 3/3241; G09G 3/325; G09G 3/3258; G09G 3/34; G09G 2310/0248; G09G 2320/045
USPC ..... 345/55, 76–78, 82, 211–213, 690; 348/800; 257/80
See application file for complete search history.

(56) References Cited

U.S. PATENT DOCUMENTS 7,812,796 B2 10/2010 Jung
7,928,932 B2 * 4/2011 Yamaguchi et al. ..... 345/76

(Continued)

FOREIGN PATENT DOCUMENTS

CN 101097683 A 1/2008
CN 101515434 A 8/2009

(Continued)

OTHER PUBLICATIONS

Chinese Office Action issued in corresponding application No. 201310068595.X dated Dec. 1, 2014—15 pages (including translation).

*Primary Examiner* — Dwayne Bost
*Assistant Examiner* — Darlene M Ritchie
(74) *Attorney, Agent, or Firm* — Fitzpatrick, Cella, Harper & Scinto

(57) ABSTRACT

A display apparatus includes: a plurality of pixel circuits 6; a reference voltage source for supplying a reference voltage to a reference voltage line 4; a first switch for connecting the reference voltage source to the reference voltage line 4; a data line 5 for supplying a data voltage to the pixel circuit, wherein the pixel circuit 6 includes a light emitting element, a driving transistor M1 having a source connected to an anode of the light emitting element, a holding capacitor CS having one end connected to a gate of the driving transistor M1 and having the other end connected to the source of the driving transistor M1, a second switch for connecting the gate of the driving transistor M1 to the data line 5, and a third switch for connecting the source of the driving transistor M1 to the reference voltage line 4.

13 Claims, 9 Drawing Sheets

(56) References Cited

U.S. PATENT DOCUMENTS

| | | | | |
|---|---|---|---|---|
| 8,514,209 | B2 | 8/2013 | Ikeda et al. | |
| 8,531,361 | B2 | 9/2013 | Nam | |
| 8,576,217 | B2 * | 11/2013 | Chaji et al. | 345/212 |
| 8,599,115 | B2 * | 12/2013 | Kimura | 345/76 |
| 8,780,022 | B2 * | 7/2014 | Toyomura et al. | 345/78 |
| 8,803,924 | B2 * | 8/2014 | Akimoto et al. | 345/690 |
| 2006/0107143 | A1 * | 5/2006 | Kim et al. | 714/726 |
| 2007/0024543 | A1 * | 2/2007 | Chung et al. | 345/76 |
| 2007/0268210 | A1 | 11/2007 | Uchino et al. | |
| 2007/0279337 | A1 * | 12/2007 | Kim et al. | 345/76 |
| 2008/0122381 | A1 | 5/2008 | Jung | |
| 2008/0142827 | A1 * | 6/2008 | Choi et al. | 257/98 |
| 2009/0213046 | A1 * | 8/2009 | Nam | 345/76 |
| 2010/0171738 | A1 * | 7/2010 | Yamashita et al. | 345/213 |
| 2011/0025653 | A1 | 2/2011 | Ikeda et al. | |
| 2011/0292019 | A1 * | 12/2011 | Yamamoto et al. | 345/211 |
| 2012/0105501 | A1 * | 5/2012 | Nakamura et al. | 345/690 |
| 2012/0200611 | A1 * | 8/2012 | Matsui et al. | 345/690 |
| 2012/0249513 | A1 * | 10/2012 | Kishi | 345/211 |
| 2012/0281156 | A1 * | 11/2012 | Tanikame | 348/800 |
| 2012/0327065 | A1 | 12/2012 | Nam | |
| 2013/0082266 | A1 * | 4/2013 | Miyake | 257/59 |

FOREIGN PATENT DOCUMENTS

| | | | |
|---|---|---|---|
| CN | 101989405 | A | 3/2011 |
| JP | 2003-271095 | A | 9/2003 |
| JP | 2007-310311 | A | 11/2007 |
| JP | 2009-282191 | A | 12/2009 |

* cited by examiner

DISPLAY APPARATUS USING REFERENCE VOLTAGE LINE FOR PARASITIC CAPACITANCE, ELECTRONIC APPARATUS USING THE DISPLAY APPARATUS AND DRIVING METHOD OF THE DISPLAY APPARATUS

BACKGROUND OF THE INVENTION

1. Field of the Invention

The present invention relates to a display apparatus including a self-emitting light emitting element, and particularly, to a display apparatus including an organic electroluminescence element (hereinafter, "organic EL element"), which is a current control element, as a light emitting element.

2. Description of the Related Art

A voltage programming pixel circuit that sets an input data voltage in each pixel is known as a pixel circuit of an active matrix organic EL display apparatus. Such a pixel circuit generally includes a driving transistor that supplies an organic EL element with a current based on the input data voltage. However, there are variations in a threshold voltage depending on the driving transistor. Therefore, there is a problem that there are variations in the luminance of the organic EL elements even if the same input data voltage is set to each pixel. To solve the problem, Japanese Patent Application Laid-Open Nos. 2003-271095 and 2007-310311 disclose voltage programming pixel circuits that use driving transistors (N type) to cancel the influence of the variations in the threshold voltage of the driving transistors.

The pixel circuit described in Japanese Patent Application Laid-Open No. 2003-271095 includes two transistors and two capacitors, and a parasitic capacitance CL connected in parallel with a current control element is larger than a holding capacitor CS connected between a gate electrode and a source electrode of the driving transistor. Therefore, when an input video signal level is divided into the parasitic capacitance CL and the holding capacitor CS, a voltage close to the input video signal level is applied to the holding capacitor CS. As a result, it is described that the input video signal level can be reduced and that there is also an advantage in terms of power consumption.

The pixel circuit described in Japanese Patent Application Laid-Open No. 2007-310311 has a similar configuration to that of Japanese Patent Application Laid-Open No. 2003-271095. A capacitive element 3I, which is a capacitive component of a light emitting element 3D, can be larger than a holding capacitor 3C from the viewpoint of the reduction in the power consumption.

However, a large layout area is necessary to form the large parasitic capacitance CL and capacitive element 3I. Since the parasitic capacitance CL and the capacitive element 3I are arranged pixel by pixel, there is a problem that the pixel size per pixel is large.

SUMMARY OF THE INVENTION

An object of the present invention is to provide a high-definition display apparatus without losing display quality and without increasing pixel size per pixel.

According to an aspect of the present invention, a display apparatus comprises: a plurality of pixel circuits; a reference voltage line; a reference voltage source for supplying a reference voltage to the reference voltage line; a first switch for connecting the reference voltage source to the reference voltage line; and a data line for supplying a data voltage to the pixel circuit, the data line being different from the reference voltage line, wherein the pixel circuit including a light emitting element, a driving transistor having a source connected to an anode of the light emitting element, a holding capacitor having one end connected to a gate of the driving transistor and having the other end connected to the source of the driving transistor, a second switch for connecting the gate of the driving transistor to the data line, and a third switch for connecting the source of the driving transistor to the reference voltage line.

According to the other aspect of the present invention, provided thereby is a driving method of a display apparatus comprising: a plurality of pixel circuits; a reference voltage line; a reference voltage source for supplying a reference voltage to the reference voltage line; a first switch for connecting the reference voltage source to the reference voltage line; and a data line for supplying a data voltage to the pixel circuit, the data line being different from the reference voltage line, wherein the pixel circuit including a light emitting element, a driving transistor having a source connected to an anode of the light emitting element, a holding capacitor having one end connected to a gate of the driving transistor and having the other end connected to the source of the driving transistor, a second switch for connecting the gate of the driving transistor to the data line, and a third switch for connecting the source of the driving transistor to the reference voltage line, and wherein the method performing: a reset operation of turning ON the first, second and third switches while applying a first reference voltage to the reference voltage line and the data line; a pre-charge operation of changing a voltage applied to the reference voltage line from the first reference voltage to a second reference voltage lower than the first reference voltage; an auto-zero operation of turning OFF the first switch to disconnect the reference voltage line from the reference voltage source; a programming operation of changing a voltage applied to the data line from the first reference voltage into a gradation data voltage; and a light emitting operation of turning OFF the second and third switches.

According to the present invention, the pixel circuit includes the holding capacitor, and the reference voltage line different from the data line includes the parasitic capacitance. Therefore, the auto-zero operation can be applied to the holding capacitor and the parasitic capacitance. As a result, there is no influence of the variations in the threshold voltage due to the driving transistor, and the display apparatus can be realized without losing the display quality. The reference voltage line includes the parasitic capacitance shared by the plurality of pixels, and a capacitor other than the holding capacitor does not have to be arranged in each pixel. Therefore, the capacitor of each pixel circuit is not enlarged, and the high-definition display apparatus can be realized without increasing the pixel size per pixel.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Exemplary embodiments of a display apparatus of the present invention will now be specifically described with reference to the drawings. Although the embodiments illustrate an example of an active matrix display apparatus using an organic EL element, the present invention can also be applied to a display apparatus using a self-emitting light emitting element other than the organic EL element.

First Embodiment

Figure 1:
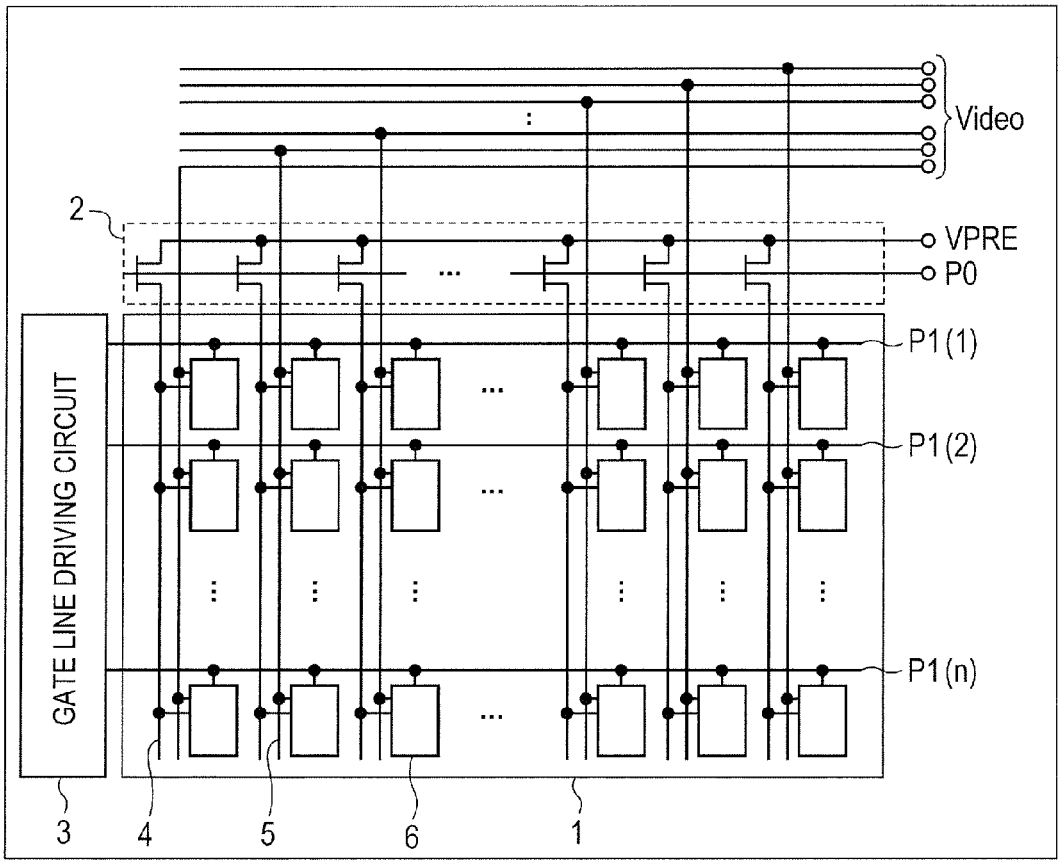
FIG. 1 is a schematic block diagram of a display apparatus applied to a first embodiment of the present invention.

FIG. 1 is a schematic block diagram of an active matrix organic EL display apparatus applied to the present embodiment. A display region 1 is formed on a substrate, and the display region includes a plurality of pixel circuits 6 including organic EL elements arranged in a matrix. A pre-charge switching circuit 2 is controlled by a P0 control signal input from an external circuit (not illustrated) and supplies a pre-charge voltage (VPRE) input from an external circuit (such as a reference voltage source) of a display panel to a reference voltage line 4. A gate line driving circuit 3 supplies P1 control signal lines (P1(1), P1(2) . . . P1(*n*), n is a natural number) to the plurality of pixel circuits 6, row by row. Video signals (Video) input from the external circuit are input to a plurality of video signal lines, and data voltages are supplied to the pixel circuits 6 arranged in the columns, through data lines 5 different from the reference voltage lines.

Although the video signals, the pre-charge voltage and the P0 control signal are input from the external circuit in the illustrated example, output signals from a controller mounted on the same substrate based on, for example, a COG method may be input as the video signals, the pre-charge voltage and the P0 control signal. The present invention is not limited to these configurations.

Figure 2:
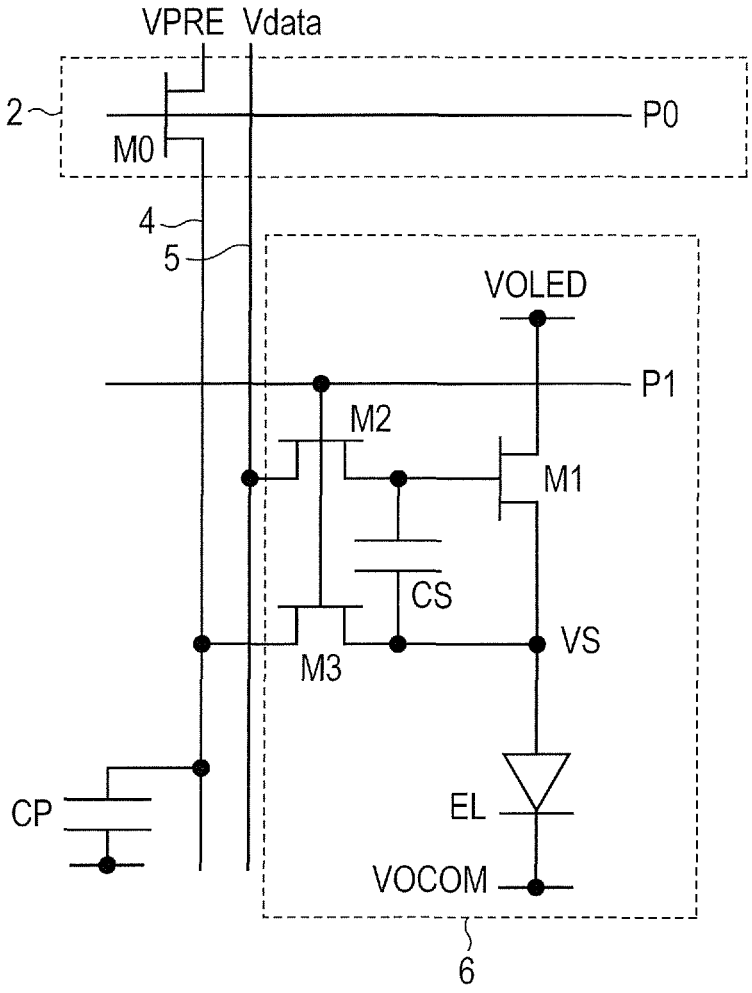
FIG. 2 is an example of a pixel circuit applied to the display apparatus of FIG. 1.

FIG. 2 illustrates the pre-charge switching circuit 2 connected to the voltage programming pixel circuit 6 and the reference voltage line 4 applied to the present embodiment.

A circuit configuration will be described first. The gates of switch transistors M2 and M3 are controlled by the P1 control signal line output from the gate line driving circuit 3. One of the source and the drain of the switch transistor M2 is connected to the data line 5, and the other of the source and the drain is connected to the gate of a driving transistor M1 with the drain connected to a current supply line VOLED and is connected to one end of a holding capacitor CS. One of the source and the drain of the switch transistor M3 is connected to the reference voltage line 4. The reference voltage line 4 is connected to one of the source and the drain of a switch transistor M0 of the pre-charge switching circuit 2. The P0 control signal line connected to the gate controls ON/OFF of the switch transistor M0, and the pre-charge voltage (VPRE) is output to the reference voltage line 4 when the switch transistor M0 is ON. A parasitic capacitance CP formed by an intersection with the control signal line for controlling the row and formed by wiring with the adjacent data line is connected to the reference voltage line 4. The other of the source and the drain of the switch transistor M3 is connected to the other end of the holding capacitor CS, to the source of the driving transistor M1, and to the positive electrode (anode) of the organic EL element. The negative electrode (cathode) of the organic EL element is connected to a common potential VOCOM commonly arranged for all pixels. The negative electrode is formed by a transparent electrode (for example, ITO or indium zinc oxide) to serve as a light extraction surface.

Although an n-type transistor is used as the driving transistor M1 in the case illustrated in FIG. 2, a p-type transistor can also be used as the driving transistor M1. The switch transistor M3, the holding capacitor CS and the organic EL element of FIG. 2 can be arranged symmetric to the driving transistor M1 when the p-type transistor serves as the driving transistor M1.

Figure 3:
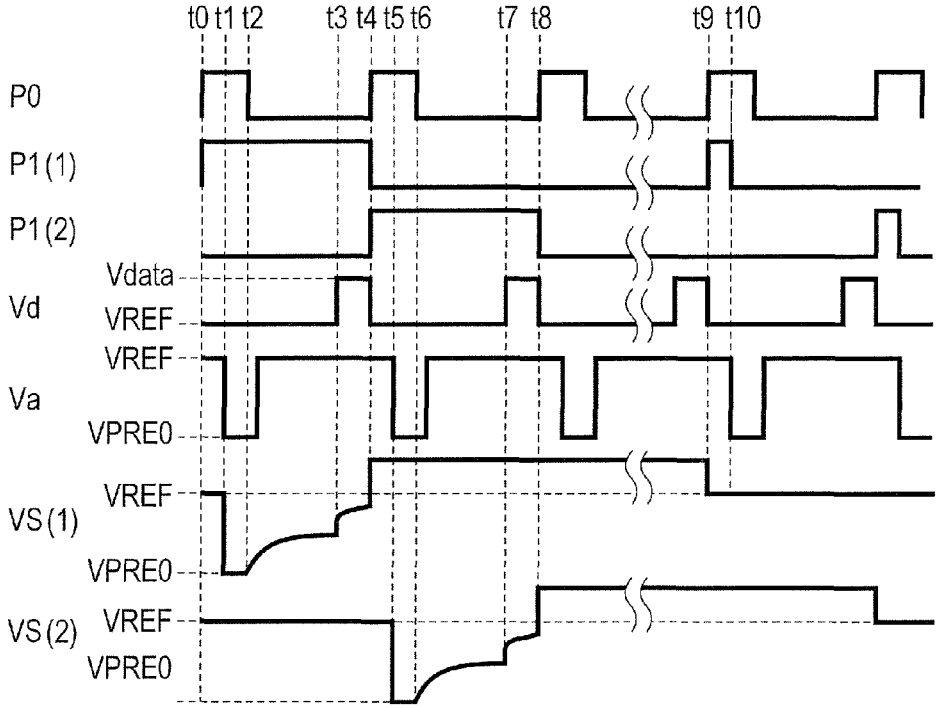
FIG. 3 is a timing chart of the pixel circuit of FIG. 2.

A specific circuit operation will be described with reference to FIG. 3. FIG. 3 illustrates the P0 control line, the P1(1) control signal line connected to the pixel circuit 6 of a first row, the P1(2) control signal line connected to the pixel circuit 6 of a second row, data line potential (Vd) and reference voltage line potential (Va). FIG. 3 further illustrates source potential VS(1) of the driving transistor M1 arranged on the pixel circuit 6 of the first row and source potential VS(2) of the driving transistor M1 arranged on the pixel circuit 6 of the second row.

The pixel circuit 6 disposed on the first row will be described first. At time t0, the P0 control signal line is in an H level, and the switch transistor M0 (first switch) of the pre-charge switching circuit 2 is switched from OFF to ON. Therefore, a Va=VREF voltage is set to the reference voltage line 4. The VREF voltage can be set lower than a threshold voltage of the organic EL element so that the organic EL element does not emit light. In order to secure the contrast, the VREF voltage can be set so that the current does not flow through the organic EL element and that the light is not emitted. The P1(1) control signal line connected to the pixel circuit 6 of the first row is in the H level, and the switch transistors M2 (second switch) and M3 (third switch) are turned ON. A Vd=VREF voltage is set to the data line 5, and gate potential and source potential of the driving transistor M1 are at the same VREF voltage. Therefore, a gate-to-source voltage (Vgs) of the driving transistor M1 is set to zero [reset operation].

At time t1, the voltage of the reference voltage line 4 is switched from the VREF voltage to a VPRE0 voltage smaller than the VREF voltage. As for the VPRE0 voltage, gate-to-source voltage (Vgs) of driving transistor M1=VREF−VPRE0 can be set greater than a threshold voltage (Vgs>Vth) to set the driving transistor M1 to have current drive capability [pre-charge operation]. Vth denotes the threshold voltage of the driving transistor M1.

At time t2, the P0 control signal line is changed from the H level to an L level. The switch transistor M0 of the pre-charge switching circuit 2 is turned OFF, and the reference voltage line 4 is disconnected from the external circuit. From the time t2 to just before time t3, the gate potential of the driving transistor M1 is held at the VREF voltage, and the source potential VS(1) floats. Therefore, the source of the driving transistor M1 is charged by the current flowing through the driving transistor M1. The current drive capability of the driving transistor M1 decreases with time, and the source potential VS(1) increases until the gate-to-source voltage (Vgs) of the driving transistor M1 reaches the threshold voltage (Vth). In this case, the source potential VS(1) of the driving transistor M1 is not greater than the threshold voltage of the organic EL element when the VREF voltage is set lower than the threshold voltage of the organic EL element. Therefore, a current does not flow through the organic EL element, and the light is not emitted. In this way, the threshold voltage (Vth) of the driving transistor M1 is set to both ends of the holding capacitor CS (Vgs=Vth), and Va=(VREF−Vth) voltage, which is a difference between VREF and Vth, is set to the parasitic capacitance CP of the reference voltage line 4 [auto-zero operation].

At the time t3, the voltage of the data line 5 is switched from the VREF voltage to a Vdata voltage of the gradation data voltage. In this case, a gradation voltage ΔV simply corresponding to a capacitor dividing ratio of the parasitic capacitance CP and the holding capacitor CS of the reference voltage line 4 is written in the gate of the driving transistor M1.

$$\Delta V=(CP/(CS+CP))\times(V\text{data}-V\text{REF}) \quad \text{Expression (1)}$$

The holding capacitor CS holds a (ΔV+Vth) voltage (Vgs=(ΔV+Vth)) [programming operation].

From the time t3 to time t4, the source potential is increased by the drive current flowing through the driving transistor M1. More specifically, the source potential is set according to drive capability β of the driving transistor M1, and the influence of β variations caused by the driving transistor M1 can be cancelled [β correction operation]. In this case, the capacitance held by the holding capacitor CS is changed by ΔV' according to the change in the source potential of the driving transistor M1. The source potential of the driving transistor M1 can be prevented from being greater than the threshold voltage of the organic EL element. Specifically, the input voltage level needs to be adjusted, or β correction operation time from the time t3 to the time t4 needs to be adjusted.

At the time t4, the P1(1) control signal line is changed from the H level to the L level, and the switch transistors M2 and M3 are turned OFF. In this way, the driving transistor M1 supplies a current according to a (ΔV'+ΔV+Vth) voltage held by the holding capacitor CS, and the organic EL element starts emitting light according to the current [light emitting operation].

At time t9, the P0 control signal line is changed from the L level to the H level, and the switch transistor M0 of the pre-charge switching circuit 2 is turned ON. The P1(1) control signal line connected to the pixel circuit 6 of the first row is in the H level, and the switch transistors M2 and M3 of the pixel circuit 6 of the first row are turned ON. The Vd=VREF voltage is set to the data line 5, and the gate potential and the source potential of the driving transistor M1 are at the same VREF voltage. Therefore, the gate-to-source voltage (Vgs) of the driving transistor M1 is set to zero. More specifically, the current supply from the driving transistor M1 to the organic EL element is terminated, and the organic EL element is lit out [lights-out operation]. Lights-out operation timing can be changed according to a necessary light emitting period. The timing may be set to be the same timing as reset operation timing of the pixel circuit of another row. The light emitting period can be set shorter than one field period, and video performance can be secured.

The pixel circuit 6 arranged on the second row will be described. At the time t4 at which the light emitting operation of the pixel circuit of the first row is started, the P0 control signal line is changed from the L level to the H level, and the switch transistor M0 of the pre-charge switching circuit 2 is turned ON. The P1(2) control signal line connected to the pixel circuit 6 is in the H level, and the switch transistors M2 and M3 are turned ON. Therefore, the Vd=VREF voltage is set to the data line 5. In this way, the gate-to-source voltage (Vgs) of the driving transistors M1 is set to zero. More specifically, the reset operation of the pixel circuit of the second row is started. Subsequently, the pre-charge operation, the auto-zero operation, the programming operation and the light emitting operation are started as in the pixel circuit 6 of the first row, and the lights-out operation is performed at reset operation timing of the pixel circuit of another row after a desired light emitting period. Furthermore, the operations will be repeated throughout the pixel circuits 6 of all rows.

What is notable here is that the pixel circuits 6 connected to the data lines 5 and the reference voltage lines 4 commonly use the parasitic capacitance CP of the reference voltage lines 4 to perform the circuit operations including the reset operation, the pre-charge operation, the auto-zero operation and the programming operation. What is also notable is that the capacitance value CP needs to be large to secure a large gradation voltage ΔV level at the programming operation as in Expression (1). In this way, the number of circuit elements necessary on a pixel-by-pixel basis can be reduced by the number of circuit elements commonly used in the plurality of circuits. The capacitors generally require layout areas larger than those of the transistors. Therefore, circuit elements that require large layout areas do not have to be arranged pixel by pixel. More specifically, the pixel size can be reduced, and the definition of the display apparatus can be increased.

Second Embodiment

Figure 4:
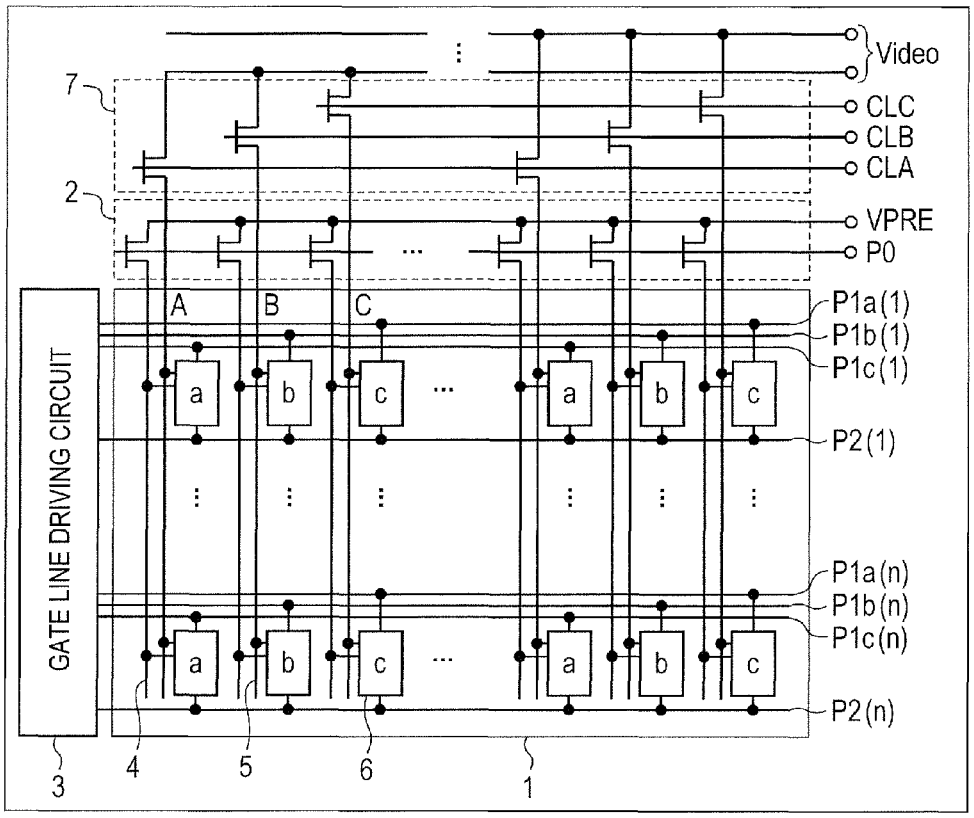
FIG. 4 is a schematic block diagram of a display apparatus applied to a second embodiment of the present invention.
Figure 5:
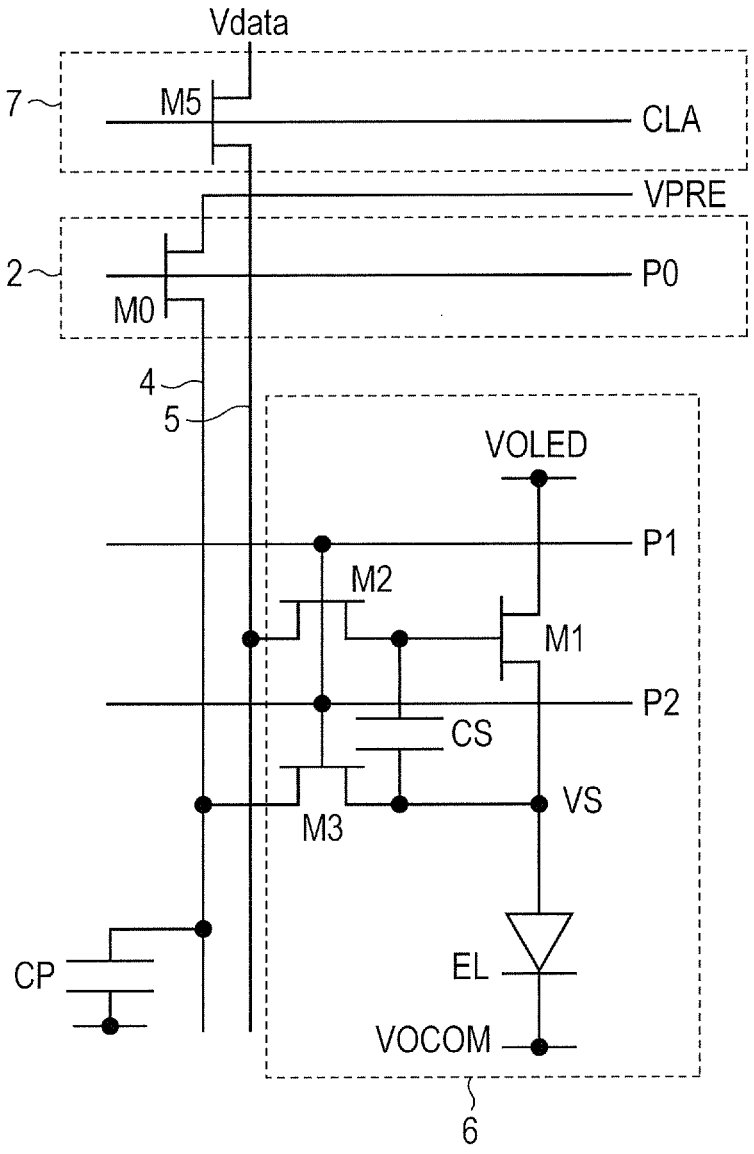
FIG. 5 is an example of a pixel circuit applied to the display apparatus of FIG. 4.

FIG. 4 is a schematic block diagram of an active matrix organic EL display apparatus applied to the present embodiment. FIG. 5 illustrates a voltage programming pixel circuit applied to the present embodiment, the pre-charge switching circuit 2 connected to the reference voltage line 4 and a data voltage switching circuit 7 connected to the data line 5. A difference from the first embodiment will be described.

Figure 6:
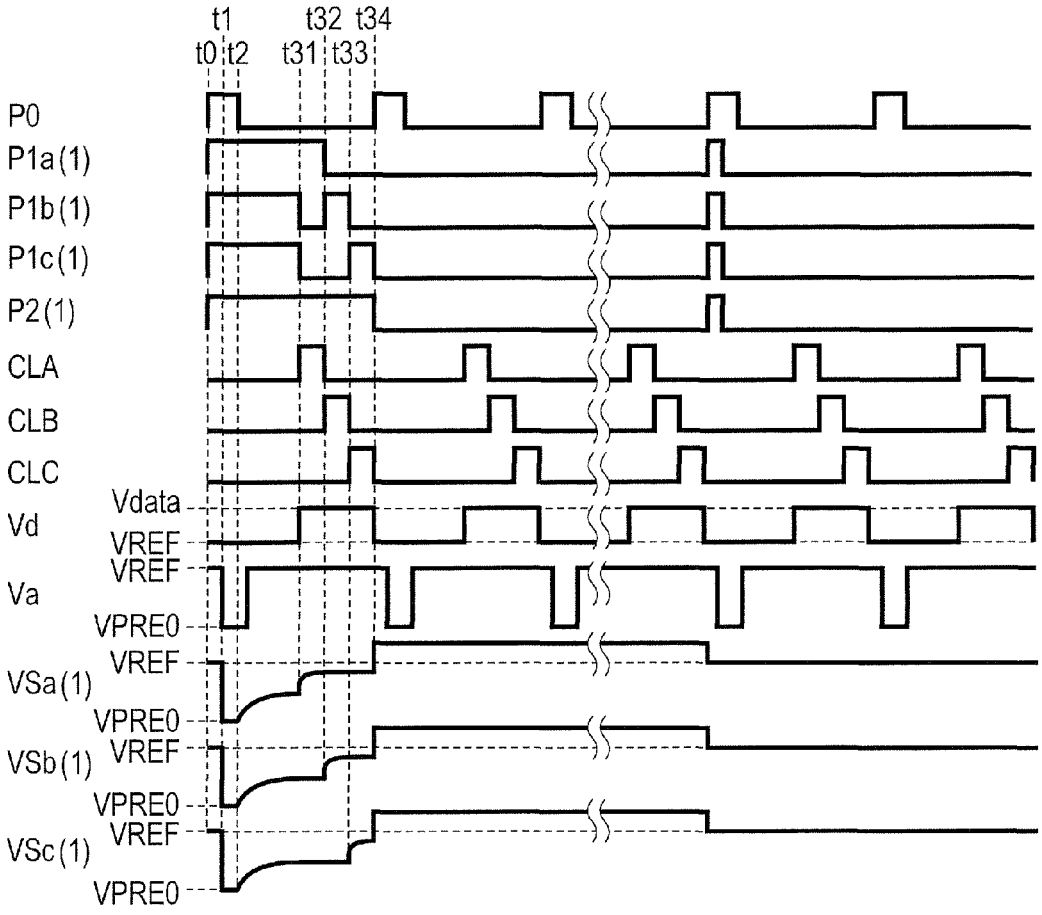
FIG. 6 is a timing chart of the pixel circuit of FIG. 5.

The difference from the first embodiment is that the data voltage switching circuit 7 connected to the data line 5 is arranged. FIG. 6 illustrates source potential of the driving transistor in the voltage programming pixel circuit arranged in the first row and control signals input to the pre-charge switching circuit 2 connected to the reference voltage line 4 and the data voltage switching circuit 7 connected to the data line 5. Three data lines A, B and C share one video signal line (Video). Up to time t31, three pixel circuits (a, b and c) connected to the data lines A, B and C arranged in the first row simultaneously perform the reset operation, the pre-charge operation and the auto-zero operation as in the first embodiment. At the time t31, a P1*a*(1) control signal line and a P2(1) control signal line are in the H level, and the switch transistors M2 and M3 of the pixel circuit a connected to the data line A are turned ON. A CLA control signal of the data voltage switching circuit 7 is in the H level, and the CLB and CLC control signals are in the L level. A switch transistor M5 (fourth switch) connected to the data line A is ON, and the switch transistors M5 connected to the data lines B and C are OFF. Therefore, the video signal is input to the data line A, and the pixel circuit a performs the programming operation. From the time t31 to time t32, the pixel circuit a performs the β correction operation. The P1*b*(1) and P1*c*(1) control signal lines are in the L level, and the switch transistors M2 of the pixel circuits b and c are OFF. The switch transistors M3 of the pixel circuits b and c are ON. Therefore, the parasitic capacitance CP connected to the reference voltage line 4 and the holding capacitor CS hold the gate potential and the source potential of the driving transistors M1 in the pixel circuits b and c.

At the time t32, the P1*b*(1) control signal line is changed from the L level to the H level. The P2(1) control signal line remains at the H level. Therefore, the switch transistors M2 and M3 of the pixel circuit b connected to the data line B are turned ON. The CLB control signal of the data voltage switching circuit 7 is in the H level, and the CLA and CLC control signals are in the L level. The switch transistor M5 connected to the data line B is ON, and the switch transistors M5 connected to the data lines A and C are OFF. Therefore, the video signal is input to the data line B, and the pixel circuit b performs the programming operation. The pixel circuit b further performs the β correction operation from the time t32 to time t33. The P1*a*(1) control signal line is changed from the H level to the L level, and the P1*c*(1) control signal line remains at the L level. Therefore, the switch transistors M2 of the pixel circuits a and c are OFF, and the switch transistors M3 are ON. Thus, the parasitic capacitance CP connected to the reference voltage line 4 and the holding capacitor CS hold the gate potential and the source potential of the driving transistors M1 in the pixel circuits a and c.

At the time t33, the P1*c*(1) control signal line is changed from the L level to the H level. The P2(1) control signal line remains at the H level. Therefore, the switch transistors M2 and M3 of the pixel circuit c connected to the data line C are turned ON. The CLC control signal of the data voltage switching circuit 7 is in the H level, and the CLA and CLB control signals are in the L level. The switch transistor M5 connected to the data line C is ON, and the switch transistors M5 connected to the data lines A and B are OFF. The video signal is input to the data line C, and the pixel circuit c performs the programming operation. The pixel circuit c further performs β correction operation from the time t33 to time t34. The P1*b*(1) control signal line is changed from the H level to the L level, and the P1*a*(1) control signal line remains at the L level. Therefore, the switch transistors M2 of the pixel circuits a and b are OFF, and the switch transistor M3 is ON. Thus, the parasitic capacitance CP connected to the reference voltage line 4 and the holding capacitor CS hold the gate potential and the source potential of the driving transistors M1 in the pixel circuits a and b.

In this way, three data lines can share one video signal line (Video) for the operation. More specifically, the number of wires of the video signal line and the number of pads for connecting the video signal lines to the outside of the panel can be reduced. The arrangement is not limited to the configuration of sharing one video signal line (Video) by three data lines, and two or more data lines may be shared.

The configuration of the present embodiment is as described above, and an effect of reducing the number of pads for connection to the outside of the panel can be attained in addition to the same effect as that of the first embodiment.

Although three P1 control signal lines (P1*a*, P1*b* and P1*c*) and one P2 control signal line are arranged as the control signal lines connected to the pixel circuits per row in the example illustrated in the present embodiment, the present embodiment is not limited to the configuration. Specifically, one P1 control signal line and three P2 control signal lines (P2*a*, P2*b* and P2*c*) may be arranged as the control signal lines connected to the pixel circuits per row. In this way, the switch transistors M2 of the pixel circuits a, b and c can be commonly turned ON/OFF, while the switch transistors M3 can be turned ON/OFF in each pixel circuit. A data line parasitic capacitance Cd that is formed by an intersection with the control signal line for controlling the row and formed by wires for the adjacent reference voltage line 4 and that is larger than the holding capacitor in the pixel circuit is connected to the data line 5. Therefore, the data line parasitic capacitance Cd may hold the gate potential of the driving transistor of the pixel circuit when the switch transistor M2 is ON and the switch transistor M3 is OFF.

Third Embodiment

Figure 7:
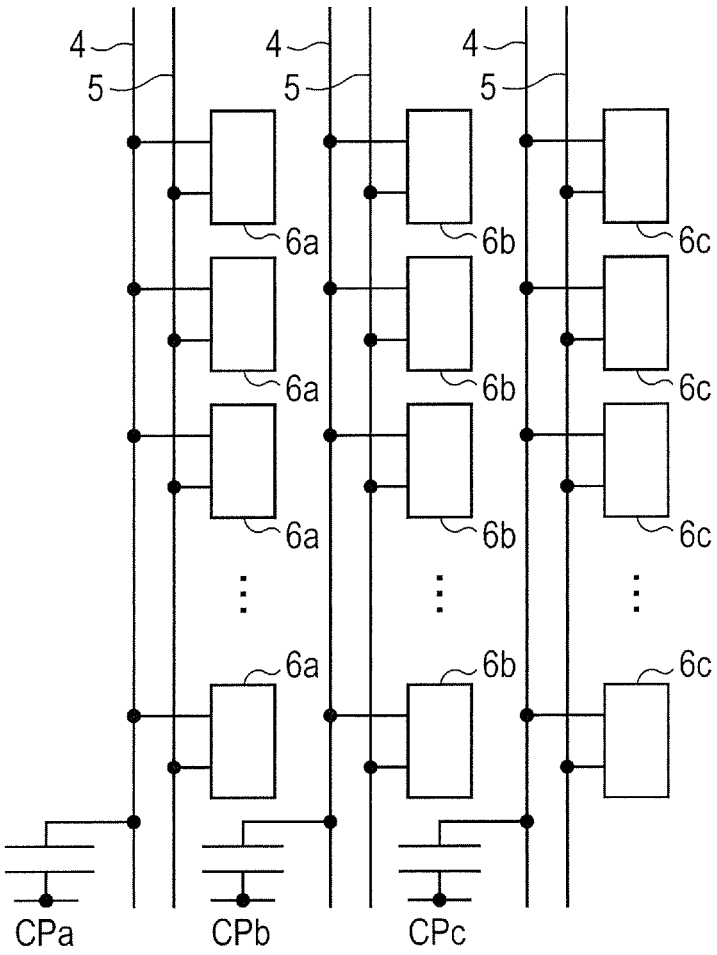
FIG. 7 is a schematic block diagram of a display apparatus applied to a third embodiment of the present invention.

FIG. 7 illustrates a schematic block diagram of three columns in a display region of an active matrix organic EL display apparatus applied to the present embodiment. A difference from the first and second embodiments will be described.

The difference from the first and second embodiments is that parasitic capacitances CP (CPa, CPb and CPc) of at least two reference voltage lines 4 of the reference voltage lines 4 arranged in the columns are different.

If the capacitance value CP is increased as indicated in Expression (1), the gradation voltage ΔV can be increased when the data line voltage Vdata and the reference voltage VREF are constant. More specifically, the drive current can be increased because Vgs of the driving transistor is increased. For example, organic EL elements in the same color are arranged in the columns, and the light emitting efficiency of the organic EL elements varies color by color. Thus, the parasitic capacitance CP of the reference voltage line 4 connected to the pixel circuit including an element of B (blue) with low light emitting efficiency among RGB is increased. More specifically, the parasitic capacitance CP is increased in the reference voltage line connected to the pixel circuit including the element of a light emitting color with low light emitting efficiency. In this way, a desired drive current can be increased without increasing the data line voltage Vdata. The width of the wiring may be enlarged to increase the capacitance value of the parasitic capacitance CP of the reference voltage line 4.

Figure 8:
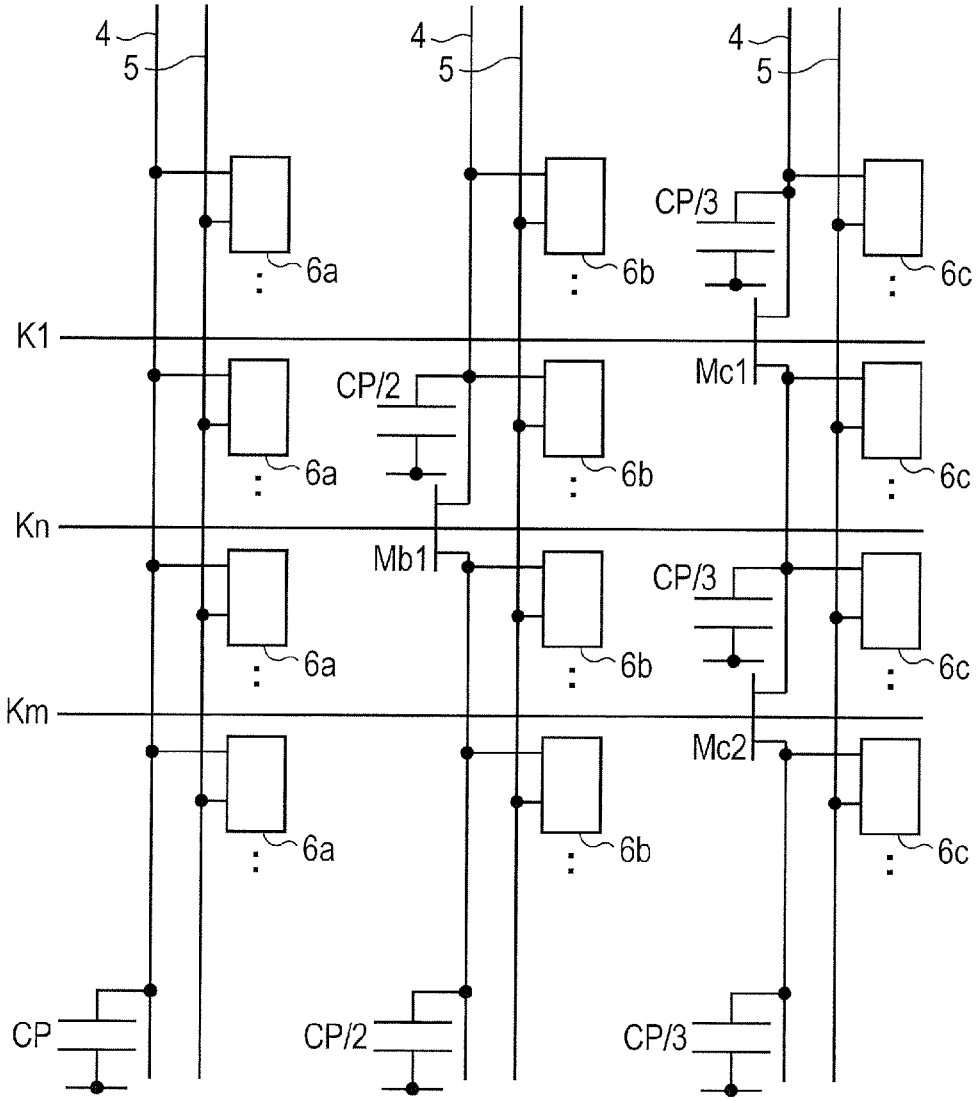
FIG. 8 is a schematic block diagram illustrating another example of the display apparatus applied to the third embodiment of the present invention.

As illustrated in FIG. 8, switches (Mb1, Mc1 and Mc2) controlled by the gate line driving circuit 3 may be arranged on the reference voltage lines 4 of the columns. The switches can divide the reference voltage lines 4 at predetermined lengths, and the parasitic capacitance of each column can be set. For example, the switches are not arranged on the reference voltage line 4 of the pixel circuit column including the element of B (blue) with low light emitting efficiency, or the number of switches is set smaller than the numbers of switches of the reference voltage lines 4 of the pixel circuit columns including the elements of the other colors. In this way, the dividable length of the reference voltage line connected to the pixel including the element with low light emitting efficiency may be set longer than that of the reference voltage lines of the pixel circuit columns of the other colors to thereby set the value of the parasitic capacitance CP larger than that of the other colors.

FIG. 8 illustrates a specific example in which the ratio of the light emitting efficiency of the light emitting elements included in the pixel circuits 6*a*, 6*b* and 6*c* is about 1:2:3. The switches are not arranged on the reference voltage line 4 connected to the pixel circuit 6*a*. The switch Mb1 can divide the reference voltage line 4 connected to the pixel circuit 6*b* into two, and the switches Mc1 and Mc2 can divide the reference voltage line 4 connected to the pixel circuit 6*b* into three. According to the switches, the parasitic capacitance values of the reference voltage lines 4 connected to the pixel circuits 6*a*, 6*b* and 6*c* can be CP:CP/2:CP/3 which is about the ratio of the inverse numbers of the light emitting efficiency. The switches Mb1, Mc1 and Mc2 arranged on the reference voltage lines 4 are turned ON during the auto-zero operation and turned OFF after the termination of the auto-zero operation. The method of setting the parasitic capacitances CP is not limited to the method described above.

The present embodiment has the configuration described above. Therefore, in addition to the same effect as that of the first embodiment, an effect of increasing a desired drive current can be attained without increasing the data line voltage Vdata.

The transistors described in the first to third embodiments can be applied to an amorphous silicon thin-film transistor, a polysilicon thin-film transistor and a single-crystal silicon transistor.

The display apparatus with the configuration described above can be used as a display unit of an electronic apparatus. The electronic apparatus takes the form of a cell phone, a computer, a digital still camera or a video camera. Alternatively, the electronic apparatus is an apparatus that realizes a plurality of functions of these.

Figure 9:
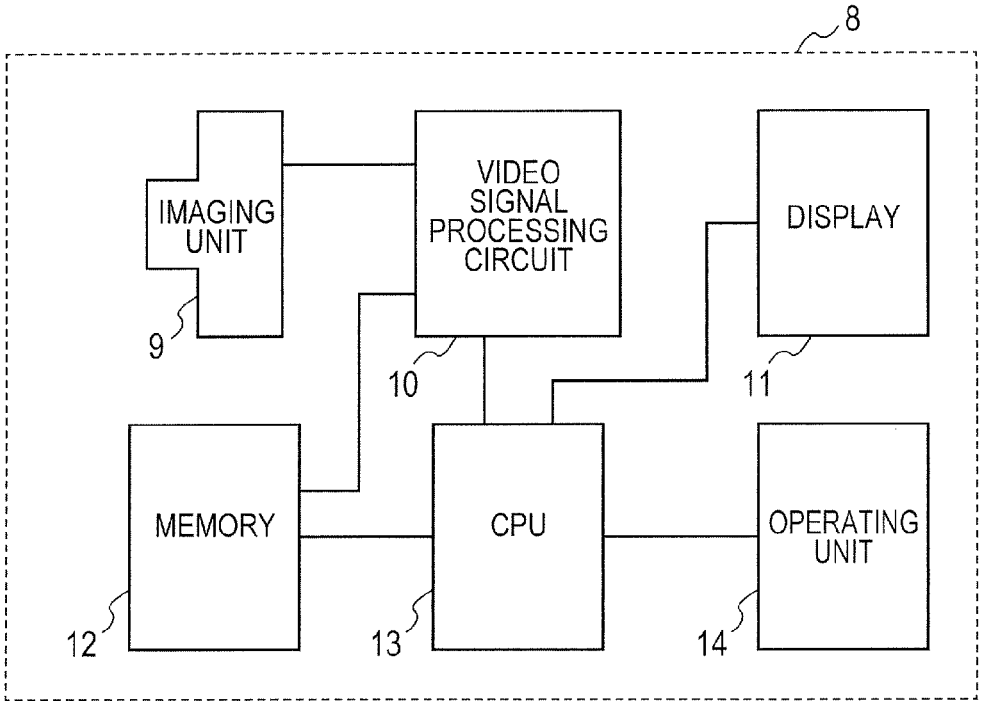
FIG. 9 is a block diagram illustrating an overall configuration of a digital still camera system using the display apparatus of the present invention.

FIG. 9 is a block diagram of an example of a digital still camera system. A digital still camera system includes an imaging unit 9, a video signal processing circuit 10, a display panel (display apparatus) 11, a memory 12, a CPU 13 and an operating unit 14. The video signal processing circuit 10 can process a video taken by the imaging unit 9 or video information recorded in the memory 12 to generate a video signal to display the video on the display panel 11. The CPU 13 controls the imaging unit 9, the memory 12 and the video signal processing circuit 10 based on input from the operating unit 14 to perform imaging, recording, reproducing and displaying suitable for the situation and displays the video on the display panel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-053168, filed Mar. 9, 2012, which is hereby incorporated by reference herein in its entirety.

What is claimed is:

1. A display apparatus comprising:

a plurality of pixel circuits;

a reference voltage line connected to each of the plurality of pixel circuits;

a reference voltage source for supplying a reference voltage to the reference voltage line;

a first switch for connecting the reference voltage source to the reference voltage line; and a data line for supplying a data voltage to each pixel circuit, and the data line being different from the reference voltage line, wherein each pixel circuit includes a light emitting element, a driving transistor having a source connected to an anode of the light emitting element, a holding capacitor having one end connected to a gate of the driving transistor and having the other end connected to the source of the driving transistor, a second switch for connecting the gate of the driving transistor to the data line, and a third switch for connecting the source of the driving transistor to the reference voltage line; and wherein the data voltage is written in the gate of the driving transistor, under a condition that the source of the driving transistor is connected to the reference voltage line, while the reference voltage line is disconnected from the reference voltage source, and that a threshold voltage of the driving transistor is held in the holding capacitor, while a difference of the reference voltage from the threshold voltage of the driving transistor is held in the parasitic capacitance of the reference voltage line.

2. The display apparatus according to claim 1, wherein the reference voltage is lower than a voltage at which the light emitting element emits light.

3. An electronic apparatus comprising:

a memory recording a video information;

a video signal processing circuit for generating a video signal by processing the video information;

a display apparatus; and a CPU for controlling the video signal processing circuit and the display apparatus, wherein the display apparatus is the display apparatus according to claim 1.

4. The display apparatus according to claim 1, further comprising a video signal line for supplying a video signal, and a fourth switch for controlling a connection between the video signal line and the data line.

5. The display apparatus according to claim 4, wherein two or more data lines share one video signal line.

6. The display apparatus according to claim 1, wherein the plurality of pixel circuits are arranged in a matrix, the light emitting elements in a same column emit lights of a same color, and a plurality of the reference voltage lines are arranged each correspondingly to each of the columns, and the reference voltage line connected to each pixel circuit including the light emitting element of a smaller light emitting efficiency is set to have a larger parasitic capacitance.

7. The display apparatus according to claim 6, wherein one or more of the reference voltage lines can be divided, by a switch thereof, into a predetermined length, and the predetermined length of the reference voltage line connected to each pixel circuit including the light emitting element of the smaller light emitting efficiency is set to have the larger parasitic capacitance.

8. The display apparatus according to claim 7, wherein a ratio of the predetermined length, into which the reference voltage line in one column is divided, to the predetermined length, into which the reference voltage line in the other column is divided, corresponds to a ratio of an inverse number of the light emitting efficiency of the light emitting element connected to the reference voltage line in the one column to an inverse number of the light emitting efficiency of the light emitting element connected to the reference voltage line in the other column.

9. The display apparatus according to claim 6, wherein the reference voltage line connected to each pixel circuit including the light emitting element of the smaller light emitting efficiency is set to have a larger width.

10. A driving method of a display apparatus comprising:

a plurality of pixel circuits;

a reference voltage line connected to each of the plurality of pixel circuits;

a reference voltage source for supplying a reference voltage to the reference voltage line;

a first switch for connecting the reference voltage source to the reference voltage line; and a data line for supplying a data voltage to each pixel circuit, the data line being different from the reference voltage line, wherein each pixel circuit includes a light emitting element, a driving transistor having a source connected to an anode of the light emitting element, a holding capacitor having one end connected to a gate of the driving transistor and having the other end connected to the source of the driving transistor, a second switch for connecting the gate of the driving transistor to the data line, and a third switch for connecting the source of the driving transistor to the reference voltage line, wherein the data voltage is written in the gate of the driving transistor, under a condition that the source of the driving transistor is connected to the reference voltage line, while the reference voltage line is disconnected from the reference voltage source, and that a threshold voltage of the driving transistor is held in the holding capacitor, while a difference of the reference voltage from the threshold voltage of the driving transistor is held in the parasitic capacitance of the reference voltage line, and wherein the method comprises:

a reset operation of turning ON the first, second and third switches while applying a first reference voltage to the reference voltage line and the data line;

a pre-charge operation of changing a voltage applied to the reference voltage line from the first reference voltage to a second reference voltage lower than the first reference voltage;

an auto-zero operation of turning OFF the first switch to disconnect the reference voltage line from the reference voltage source;

a programming operation of changing a voltage applied to the data line from the first reference voltage into a gradation data voltage; and a light emitting operation of turning OFF the second and third switches.

11. The driving method according to claim 10, wherein the first reference voltage is lower than a voltage at which the light emitting element emits light.

12. The driving method according to claim 10, wherein a difference between the first and second reference voltages is larger than the threshold voltage of the driving transistor.

13. The driving method according to claim 10, wherein the reference voltage line is provided with a switch for dividing the reference voltage line into a predetermined length, and the switch is turned ON during the auto-zero operation, and is turned OFF after a termination of the auto-zero operation.

* * * * *